United States Patent [19]

Sakai

[11] 4,281,051

[45] Jul. 28, 1981

[54] THREE COLOR ELECTROSTATOGRAPHIC PROCESS

[75] Inventor: Katsuo Sakai, Tokyo, Japan

[73] Assignee: Ricoh Company, Ltd., Tokyo, Japan

[21] Appl. No.: 96,729

[22] Filed: Nov. 23, 1979

[30] Foreign Application Priority Data

Nov. 29, 1978 [JP] Japan ..... 53-147430

[51] Int. Cl.[3] ..... G03G 13/01

[52] U.S. Cl. ..... 430/42; 430/45; 430/46; 430/31; 430/57

[58] Field of Search ..... 430/42, 45, 46

[56] References Cited

U.S. PATENT DOCUMENTS

| | | | |
|---|---|---|---|
| 2,962,375 | 11/1960 | Schaffert | 430/46 |
| 3,647,427 | 2/1972 | Hanada et al. | 430/67 X |
| 3,679,405 | 7/1972 | Makino et al. | 430/64 X |
| 3,692,519 | 9/1972 | Takahashi | 430/42 |
| 3,775,106 | 11/1973 | Tamai et al. | 430/42 |
| 3,795,513 | 3/1974 | Ciuffini | 430/84 X |
| 3,801,317 | 4/1974 | Tanaka et al. | 430/67 X |
| 3,844,783 | 10/1974 | Matsumoto et al. | 430/43 |
| 3,884,686 | 5/1975 | Bean | 430/43 |
| 4,039,831 | 8/1977 | Lehmann | 430/42 |
| 4,078,929 | 3/1978 | Gundlach | 430/31 |

OTHER PUBLICATIONS

Schaffert, "Increasing the Sensitivity of Xerographic Photoconductors", IBM Tech. Discl. Bull., vol. 6, No. 10, Mar. 1964, p. 60.

*Primary Examiner*—Roland E. Martin, Jr.
*Attorney, Agent, or Firm*—David G. Alexander

[57] ABSTRACT

A photoconductive material (11) is provided which has first and second photoconductive layers (13), (14) of different spectral sensitivities. The material (11) is charged at least twice to form a stratified charge pattern of opposite polarities. A color light image of an original document (24) is radiated onto the material (11) to form an electrostatic surface potential pattern having high and low potential areas of one polarity and another area of the opposite polarity corresponding to three respective colors. The areas are developed separately using toners of the three respective colors to form a three color toner image which is transferred to a copy sheet (36). One of the colors may be black.

4 Claims, 8 Drawing Figures

THREE COLOR ELECTROSTATOGRAPHIC PROCESS

BACKGROUND OF THE INVENTION

The present invention relates to a three color electrophotographic or electrostatic copying process.

Color electrostatic copying machines which produce full color copies are known in the art. These are generally of two types. The first type comprises a single photoconductive drum or belt which is exposed to a light image of an original document three times through filters of three primary colors respectively. After each imaging operation, a toner substance of a corresponding color is applied to the drum to form a color toner image which is transferred to a copy sheet. In this manner, three color toner images are sequentially formed on the drum and transferred to the copy sheet in register to produce a color copy. Often, a fourth black toner image is formed and transferred to the copy sheet in register with the three color toner images.

In such a copy machine it is essential that the toner images be transferred to the copy sheet in perfect register. The control mechanism for such a copying machine is therefore intricate and expensive. The three or four imaging operations for each copy require a disproportionate amount of time, making the process very slow.

The second type of color copying machine is much faster in operation but also much more expensive to manufacture. Such a copying machine comprises three or four photoconductive drums or belts. The original document is passed over all of the drums in one scanning movement, sequentially imaging the drums through three respective primary color filters. A toner development unit is associated with each drum. The copy sheet is fed through the machine in one pass, with the toner images being transferred thereto in register through sequential engagement with the drums.

In addition to the increased cost of the three or four drums compared to only one drum or belt in the first type of color copying machine, an intricate mechanism is also required in the second type of machine to ensure perfect register of the three of four toner images on the copy sheet.

A full color copying machine is unnecessary in many business operations where only commercial documents are copied, since such documents generally only comprise the colors black and red, in addition to a white background. This is because accounting records and the like generally contain credit entries in black and debit entries in red. Since in many such documents the debit and credit entries may be distinguished from each other only by the color of ink many offices have purchased or leased full color copying machines for copying such records. The full color copying capability is wasted since it is only necessary to distinguish red from black on the copies.

Electrostatic copying processes which are capable of producing two color copies in a unique and simplified manner are disclosed in Japanese patent application numbers 52-68343, 52-82660, 53-13273, 53-18754, 53-50664, 53-55789 and 53-60211 which are assigned to the same assignee as this application.

Such a process comprises the steps of providing a material including a first photoconductive layer which is insensitive to light of a predetermined color, a second photoconductive layer which is sensitive to light of the predetermined color and a transparent insulating layer, forming an electrostatic charge pattern in the material in such a manner that electrostatic charges of opposite polarities are formed at outer surfaces of the first and second photoconductive layers respectively, radiating a color light image onto an outer surface of the material and applying two toners of different colors which are charged to opposite electrostatic polarities respectively to the outer surface of the material.

The present invention constitutes a major improvement over the prior process in that it enables copying in three colors such as black, red and green or black, red and blue.

SUMMARY OF THE INVENTION

An electrostatographic process embodying the present invention comprises the steps of providing a photoconductive material having a first photoconductive layer which is sensitive to light of a first color and insensitive to light of a second color and a second photoconductive layer which is sensitive to light of the second color and insensitive to light of the first color, the first and second photoconductive layers being insensitive to light of a third color, forming an electrostatic charge pattern in the material in such a manner that electrostatic charges of opposite polarities are formed at outer surfaces of the first and second photoconductive layers respectively, radiating a color light image comprising the first, second and third colors onto the material to form an electrostatic surface potential pattern having a high potential of a first polarity in an area radiated with the first color, a low potential of the first polarity in an area radiated with the third color and a potential of a second polarity in an area radiated with the second color, applying a toner of a fourth color charged to the first polarity to the material to form a first toner image in the area radiated with the second color, applying a toner of a fifth color charged to the second polarity to the material to form a second toner image in the area radiated with the first color while applying a bias voltage which prevents the toner of the fifth color from adhering to the area radiated with the third color, radiating the material with light of a color which causes one of the first and second photoconductive layers to photoconduct and increase the surface potential in the area radiated with the third color, and applying a toner of a sixth color charged to the second polarity to the material to form a third toner image in the area radiated with the third color.

In accordance with the present invention, a photoconductive material is provided which has first and second photoconductive layers of different spectral sensitivites. The material is charged at least twice to form a stratified charge pattern of opposite polarities. A color light image of an original document is radiated onto the material to form an electrostatic surface potential pattern having high and low potential areas of one polarity and another area of the opposite polarity corresponding to three respective colors. The areas are developed separately using toners of the three respective colors to form a three color toner image which is transferred to a copy sheet. One of the colors may be black.

It is an object of the present invention to provide a simplified but effective three color electrostatoghraphic process.

It is another object of the present invention to provide a generally improved color electrostatographic process.

Other objects, together with the foregoing, are attained in the embodiments described in the following description and illustrated in the accompanying drawing.

DESCRIPTION OF THE PREFERRED EMBODIMENTS

While the electrostatographic process of the present invention is susceptible of numerous physical embodiments, depending upon the environment and requirements of use, substantial numbers of the herein shown and described embodiments have been made, tested and used, and all have performed in an eminently satisfactory manner.

Figure 1:
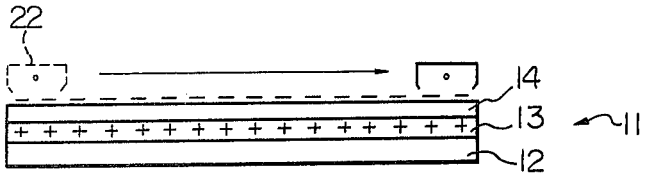
FIGS. 1 to 6 are diagrams illustrating the respective steps of the present electrostatographic process.

Referring now to FIG. 1 of the drawing, a photoconductive material embodying the present invention is generally designated by the reference numeral 11 and comprises an electrically conductive and grounded substrate 12. Formed on the substrate 12 is a photoconductive layer 13 sensitive to red light but insensitive to green light. Formed on the layer 13 is a photoconductive layer 14 which is sensitive to green light but insensitive to red light. Naturally, both layers 13 and 14 are insensitive to black light which is constituted by absence of chromatic color. Both layers 13 and 14 are sensitive to white light, which is constituted by all chromatic colors, since white light contains both red and green light. Although not illustrated, it is well within the scope of the present invention to form a transparent insulating layer on the layer 14, between the layers 13 and 14, between the substrate 12 and layer 13 or any of these transparent layers in any combination. The layer 14 is transparent to at least red light.

Figure 7:
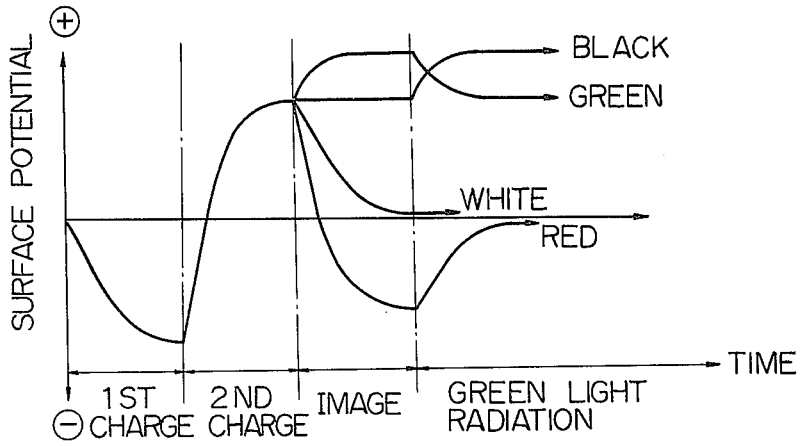
FIG. 7 is a graph illustrating the electrostatic surface potential in three color areas produced by the steps of FIGS. 1 to 6.
Figure 8:
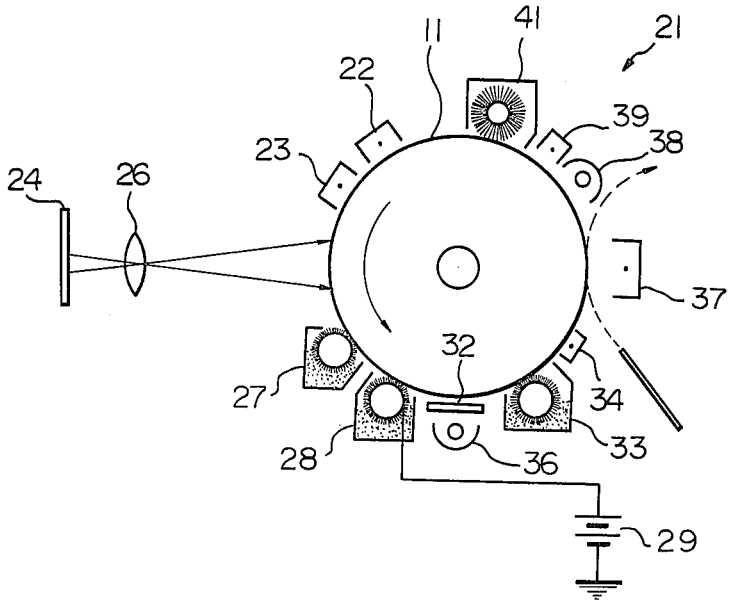
FIG. 8 is a schematic diagram of an electrostatic copying machine for practicing the present process.

The first step of the process is illustrated in FIG. 1 and will be described with reference also being made to FIG. 7 which illustrates the electrostatic surface potential on the upper surface of the layer 14 and FIG. 8 which illustrates an electrostatic copying machine or apparatus 21 for practicing the present process. Although the material 11 is illustrated as being flat in FIG. 1, it is constituted by a drum in FIG. 8 which is rotated counterclockwise at constant speed.

In the first step of the process, the drum or material 11 is electrostatically charged to a negative potential by a corona charger 22. The layer 13 is made of a semiconductive material so that holes from the substrate 12 are caused to migrate to the interface of the layers 13 and 14. A negative charge is formed on the surface of the layer 14 since the layer 14 does not conduct.

Figure 2:
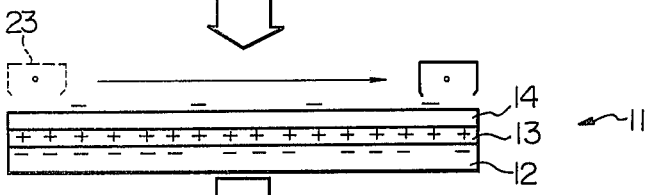

In the next step of the process which is illustrated in FIG. 2, the material 11 is charged to a positive polarity by a corona charger 23. This dissipates part of the negative charge on the surface of the layer 14 and causes the surface potential of the material to be reversed from negative to positive. This is because with some of the negative charge removed from the surface of the layer 14, the positive charge at the interface of the layers 13 and 14 prevails.

Figure 3:
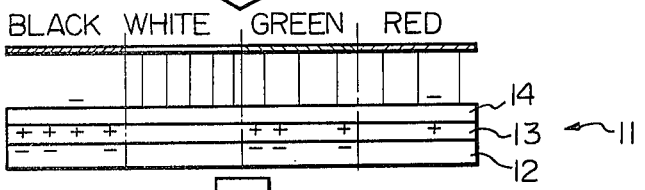

In FIG. 3, a light image of an original document 24 is radiated onto the material 11 by means of an optical imaging means symbolically shown as being in the form of a converging lens 26. The light image has at least black, white, red and green areas which are illustrated in FIG. 3.

No photoconduction occurs in the black area since neither of the layers 13 and 14 conducts. Thus, the surface potential in the black area remains the same with a positive polarity.

Both layers 13 and 14 conduct in the white area, reducing the surface potential to substantially zero.

Only the outer layer 14 conducts in the green area, causing the negative charge on the surface of the layer 14 to be dissipated. However, the positive charge at the interface of the layers 13 and 14 remains, causing the surface potential in the green area to become more positive than the surface potential in the black area.

Only the layer 13 conducts in the red area, dissipating the positive charge at the interface of the layers 13 and 14. However, the negative charge on the surface of the layer 14 remains, with the result that the surface potential in the red area is reversed from positive to negative.

To summarize the results of the step of FIG. 3, the electrostatic surface potential of the material 11 is zero in the white area, negative in the red area, positive with a high potential in the green area and positive with a low potential in the black area.

Figure 4:
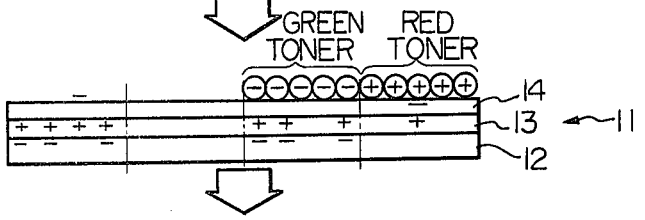
Figure 5:
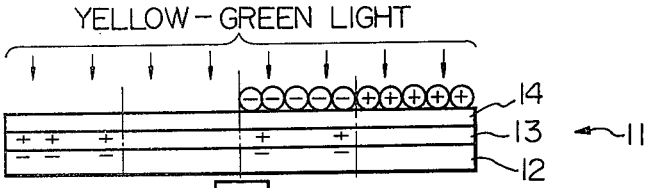

In the next step of FIG. 4, the red image is developed by a magnetic brush developing unit 27 which applies red toner which is positively charged to the material 11. The red toner adheres only to the red image area of the material 11 since only this area has a negative surface potential which attracts the positively charged red toner. Next, the green image area is developed by a magnetic brush developing unit 28 which applies a negatively charged green toner to the material or drum 11. A bias voltage source 29 applies a positive bias voltage to the unit 28 which has a value sufficiently high to prevent the green toner from adhering to the black image area. The bias voltage is typically slightly higher than the potential in the black image area.

It is well within the scope of the present invention to develop the green toner image before developing the red toner image, or to develop the red and green toner images simultaneously using a mixture of positively charged red toner and negatively charged green toner.

The next step of the process is to radiate the material 11 with yellow-green light which makes only the layer 14 conduct. This is performed with a white light source 31 in combination with a yellow-green filter 32. This radiation causes the negative charge at the surface of the layer 14 in the black image area to be dissipated and the surface potential in the black image area to increase to a more positive value. The surface potential in the green image area is somewhat reduced by this radiation and also by the negative green toner.

Figure 6:
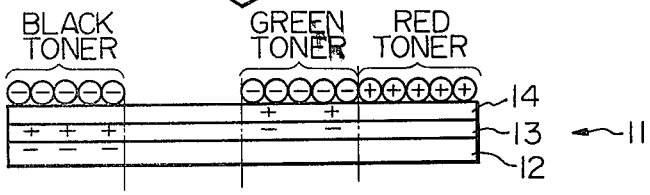

The next step is illustrated in FIG. 6 and consists of developing the black image with negatively charged black toner by means of a magnetic brush developing unit 33. The black toner adheres to the black image area but does not adhere to the green image area due to the fact that the positive surface potential is reduced in the green image area and the green image area is saturated with green toner. Completion of the step of FIG. 6 results in the formation of a three color (black, red and green) toner image on the material 11.

Next, the three color toner image is converted to uniform polarity by a precharger 34. A copy sheet 36 is fed into contact with the drum 11 at the same surface speed thereas in such a manner that the leading edge of the toner image registers with the leading edge of the sheet 36. A transfer charger 37 applies an electrostatic charge which has the opposite polarity of the precharger 34 which causes the toner image to be transferred from the drum 11 to the copy sheet 36. After the transfer operation, a fixing-unit which is not illustrated fixes the toner image to the copy sheet 36 through heat, pressure or a combination thereof.

The drum 11 is then discharged by means of a lamp 38 and a corona discharging unit 39 and any residual toner is removed by a cleaning unit 41.

The present invention is not limited to copying in the colors red, black and green. Any combination of three colors may be used by suitably selecting the spectral sensitivities of the layers 13 and 14. Black, for example, may be replaced by a chromatic color to which the layers 13 and 14 are insensitive. The colors of the toners do not have to correspond to the colors of the light image, since the main point is to distinguish three colors from each other. However, correspondence of colors will produce the most natural copy. Another preferred combination of colors is red, black and blue.

The following experiments were conducted to demonstrate the effectiveness of the present process.

EXPERIMENT 1

The three colors were selected to be red, black and green. The material 11 was prepared as follows. The layer 13 was formed by evaporating 99.9% pure selenium on the aluminum substrate 12 at 74° C. to a thickness of 50 microns. This layer 13 was sensitive to red and blue light. After evaporation, the material was left in the dark for one week after which time the layer 14 was formed thereon. The layer 14 comprised zinc oxide resin sensitized with Rose bengale coated on the layer 13 by a doctor blade to a thickness of 12 microns. The zinc oxide layer 14 was only sensitive to green light.

A corona discharge of −6.5 KV was applied to the material 11 which resulted in a surface potential of −1100 V. The charge was applied in the dark. However, the first charge was formed due to the semiconductive property of selenium which allowed hole migration from the substrate 12 to the interface of the layers 13 and 14.

Then, a corona discharge of +4.7 KV was applied to the material 11 in the dark resulting in a surface potential of +410 V. This second charging neutralized most of the surface potential resulting from the first charge. The result was a stratified charge pattern with a positive charge at the interface of the layers 13 and 14 and a negative charge on the surface of the layer 14.

The material 11 was then imaged with a light image having red, black, green and white image areas. After imaging, the surface potential in the white image area was −20 V. The surface potential in the red image area was −330 V. The surface potential in the green image area was +650 V, while the surface potential in the black image area was +390 V.

The red image was developed using an experimental red toner charged to positive polarity while applying a bias voltage of −50 V. Then, the green image, having the highest positive potential, was developed using an experimental negatively charged green toner while applying a bias voltage of +400 V, slightly higher than the surface potential in the black image area.

Then, the material 11 was radiated with yellow green light in a wavelength range from 520 nanometers to 650 nanometers using an experimental dichroic mirror. After this step, the surface potential in the white image area was −10 V. The surface potential in the red image area was −20 V. The surface potential in the black image area was +620 V. The surface potential in the green image area was +550 V. The increased surface potential in the black image area resulted from the dissipation of the negative charge at the surface of the layer 14. The surface potential in the green image area decreased due to photoconduction and the negative green toner on the layer 14. The red image area had a small negative charge due to electrostatic induction by the positive red toner.

Then, the black image area was developed using a negatively charged black toner no. FT-6000 manufactured by the Ricoh Company, Ltd. of Tokyo, Japan. After precharging, the three color toner image was transferred to a copy sheet and provided an excellent, clear copy. Although no bias voltage was applied during the black developing step, no black toner adhered to the green image area, probably due to the fact that the green image was developed to saturation with the green toner.

EXPERIMENT 2

Another material 11 was prepared by evaporating selenium of 99.9% purity on an aluminum substrate at 50° C. to a thickness of 10 microns. The resulting layer 13 was sensitive only to blue light. After being left for one week in the dark, a layer 14 was coated on the layer 13 to a thickness of 25 microns by a doctor blade. The layer 14 comprised a mixture of polycarbonate resin and $\beta$-type $\kappa$-phthalocyanine which was milled for three hours. The ratio of polycarbonate resin to $\kappa$-phthalocyanine was three to one by weight. The layer 14 was sensitive only to red light.

The resulting material 11 was charged in the dark to a surface potential of −1500 V and then charged again by a positive corona charger to reduce the surface potential to −570 V in the dark.

Then, the material 11 was radiated with a light image having white, red, blue and black areas. The surface potential was −40 V in the white area, +330 V in the red area, −820 V in the blue area and −550 V in the black area. The resulting electrostatic image was developed using negatively charged experimental red toner without any bias voltage. Then, the blue area was developed using an experimental positively charged blue toner while applying a bias voltage of −600 V.

As the next step, the material 11 was radiated with blue light which made the surface potential in the black image area increase to −800 V. The black image area was developed using a positively charged experimental black toner without bias voltage. The resulting three color toner image was transferred to a copy sheet to produce a clear copy without mixing of colors.

EXPERIMENT 3

Experiments 1 and 2 were repeated with the difference that the material 11 was illuminated with red light rather than blue or green light. This made the potential in the black image area equal to the potential in the red image area before the red light radiation. The black image was developed using a black toner which was charged to the same polarity as the red toner. The results were excellent as in the previous experiments.

EXPERIMENT 4

Experiments 1 and 2 were repeated with the difference that an area of the light image was passed through a dichroic mirror which completely reflected blue light but transmitted green and red light. The result was that a black image area passed through the mirror was changed into a red image area on the copy.

EXPERIMENT 5

Experiment 2 was repeated with the difference that the material 11 was radiated with a light image having red, blue and green image areas on a white background. The red and blue image areas were developed, and the material was radiated with blue light. Then, the green area was developed. The result was a copy having clear and unmixed red, blue and green images.

EXPERIMENT 6

Experiments 1 and 2 were repeated with the difference that the intensity of the light image was adjusted to a value at which the surface potential in the green or blue image area was not charged to the saturation point. The green or blue image was developed and then the material 11 was radiated with red light to cause the surface potential in the black image area to be increased to the saturation point. Since the blue or green image had already been developed, the red light radiation in this area did not substantially change due to the fact that the toner absorbed light. Then, the black image was developed while applying a bias voltage having a value approximately equal to the surface potential in the green or blue image area. The result was an excellent copy with no color mixing.

In summary, it will be seen that the present invention provides a three color electrostatographic process which is greatly improved over the prior art. Various modifications will become possible for those skilled in the art after receiving the teachings of the present disclosure without departing from the scope thereof.

What is claimed is:

1. An electrostatographic process comprising the steps of:

(a) providing a photoconductive material having a first photoconductive layer which is sensitive to light of a first color and insensitive to light of a second color and a second photoconductive layer which is sensitive to light of the second color and insensitive to light of the first color, the first and second photoconductive layers being insensitive to light of a third color;

(b) forming uniform electrostatic charges of opposite polarities at outer surfaces of the first and second photoconductive layers respectively;

(c) radiating a color light image comprising the first, second and third colors onto the material to form an electrostatic surface potential pattern having a high potential of a first polarity in an area radiated with the first color, a low potential of the first polarity in an area radiated with the third color and a potential of a second polarity in an area radiated with the second color;

(d) applying a toner of a fourth color charged to the first polarity to the material to form a first toner image in the area radiated with the second color;

(e) applying a toner of a fifth color charged to the second polarity to the material to form a second toner image in the area radiated with the first color while applying a bias voltage which prevents the toner of the fifth color from adhering to the area radiated with the third color;

(f) radiating the material with light of a color which causes one of the first and second photoconductive layers to photoconduct and increase the surface potential in the area radiated with the third color; and (g) applying a toner of a sixth color charged to the second polarity to the material to form a third toner image in the area radiated with the third color;

step (a) further comprising providing substrate, the first photoconductive layer being formed on the substrate and the second photoconductive layer being formed on the first photoconductive layer, the first photoconductive layer being semiconductive, step (b) comprising charging the second photoconductive layer with the second polarity which causes current flow from the substrate through the first photoconductive layer to an interface of the first and second photoconductive layers and then charging the second photoconductive layer with the first polarity for partially neutralizing the charge of the second polarity on the second photoconductive layer.

2. A process as in claim 1, in which the third color is black.

3. A process as in claim 1, in which the fourth, fifth and sixth colors are the same as the first, second and third colors respectively.

4. A process as in claim 1, in which step (f) comprises radiating the material with light of the first color.

* * * * *